US005950162A

United States Patent [19]

Corrigan et al.

[11] Patent Number: 5,950,162

[45] **Date of Patent: *Sep. 7, 1999**

[54] METHOD, DEVICE AND SYSTEM FOR GENERATING SEGMENT DURATIONS IN A TEXT-TO-SPEECH SYSTEM

[75] Inventors: Gerald Corrigan, Chicago; Orhan Karaali, Rolling Meadows; Noel Massey, Hoffman Estates, all of Ill.

[73] Assignee: Motorola, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/739,975

[22] Filed: Oct. 30, 1996

[51] Int. Cl.[6] ..... G10L 5/06; G10L 9/00

[52] U.S. Cl. ..... 704/260; 704/259

[58] Field of Search ..... 704/260, 232, 704/200, 268, 259

[56] References Cited

U.S. PATENT DOCUMENTS

| | | | |
|---|---|---|---|
| 3,632,887 | 1/1972 | Leipp . | |
| 3,704,345 | 11/1972 | Coker et al. . | |
| 5,041,983 | 8/1991 | Nakahara et al. . | |
| 5,163,111 | 11/1992 | Baji et al. . | |
| 5,230,037 | 7/1993 | Giustiniani et al. | 704/200 |
| 5,327,498 | 7/1994 | Hamon | 704/268 |
| 5,384,893 | 1/1995 | Hutchins | 704/258 |
| 5,463,713 | 10/1995 | Hasegawa | 704/260 |
| 5,475,796 | 12/1995 | Iwata | 704/260 |
| 5,610,812 | 3/1997 | Schabes et al. | 704/9 |
| 5,627,942 | 5/1997 | Nightingale et al. | 395/23 |
| 5,642,466 | 6/1997 | Narayan | 704/200 X |
| 5,652,828 | 7/1997 | Silverman | 704/260 |
| 5,668,926 | 9/1997 | Karaali et al. | 704/232 |

FOREIGN PATENT DOCUMENTS

| | | | |
|---|---|---|---|
| WO 89/02134 | 3/1989 | United Kingdom | 704/200 X |

OTHER PUBLICATIONS

Scorkilis et al., "Text Processing for Speech Synthesis Using Parallel Distributed Models", 1989 IEEE Proc, Apr. 9–12, 1989, pp. 765–769, vol. 2.

Tuerk et al., "The Development of Connectionist Multiple–Voice Text–To–Speech System" Int'l Conf on Acoustics Speech & Signal Processing, May 14–17, 1991 pp. 749–752 vol. 2.

*Primary Examiner*—David R. Hudspeth
*Assistant Examiner*—Robert Louis Sax
*Attorney, Agent, or Firm*—Darleen J. Stockley

[57] ABSTRACT

The present invention teaches a method (400), device and system (300) utilizing at least one of: mapping a sequence of phones to a sequence of articulatory features and utilizing prominence and boundary information, in addition to a predetermined set of rules for type, phonetic context, syntactic and prosodic context for phones to provide provide a system that generates segment durations efficiently with a small training set.

22 Claims, 4 Drawing Sheets

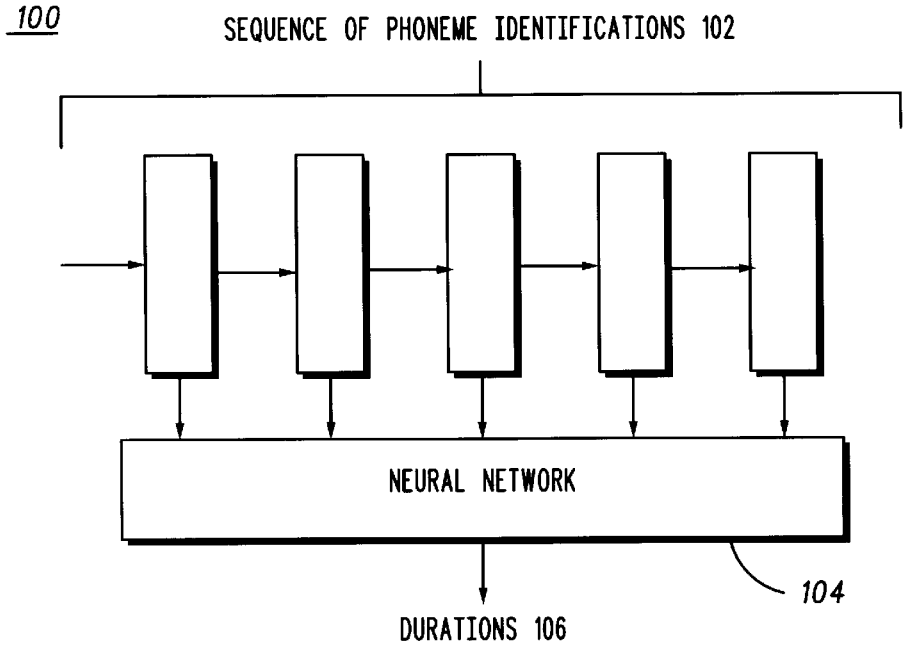
FIG.1
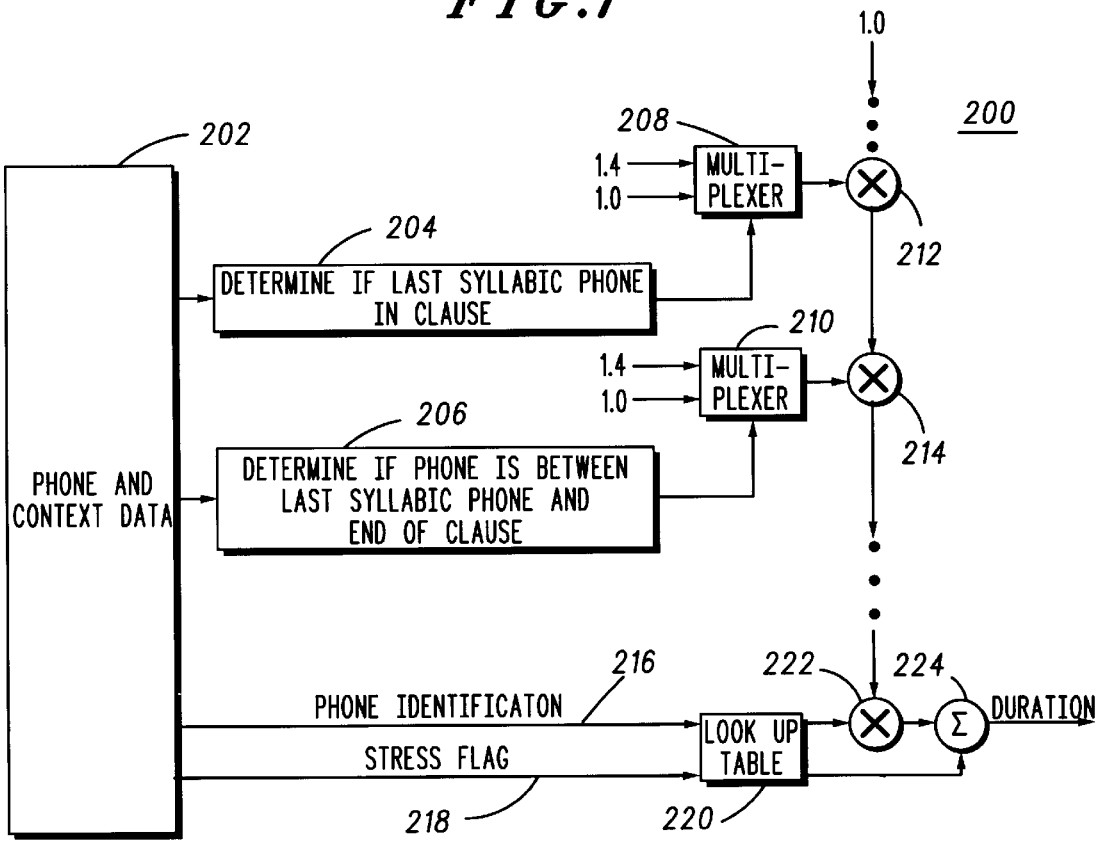
FIG.2 —PRIOR ART—

METHOD, DEVICE AND SYSTEM FOR GENERATING SEGMENT DURATIONS IN A TEXT-TO-SPEECH SYSTEM

FIELD OF THE INVENTION

The present invention is related to text-to-speech synthesis, and more particularly, to segment duration generation in text-to-speech synthesis.

BACKGROUND

To convert text to speech, a stream of text is typically converted into a speech wave form. This process generally includes determining the timing of speech events from a phonetic representation of the text. Typically, this involves the determination of the durations of speech segments that are associated with some speech elements, typically phones or phonemes. That is, for purposes of generating the speech, the speech is considered as a sequence of segments during each of which, some particular phoneme or phone is being uttered. (A phone is a particular manner in which a phoneme or part of a phoneme may be uttered. For example, the 't' sound in English, may be represented in the synthesized speech as a single phone, which could be a flap, a glottal stop, a 't' closure, or a 't' release. Alternatively, it could be represented by two phones, a 't' closure followed by a 't' release.) Speech timing is established by determining the durations of these segments.

In the prior art, rule-based systems generate segment durations using predetermined formulas with parameters that are adjusted by rules that act in a manner determined by the context in which the phonetic segment occurs, along with the identity of the phone to be generated during the phonetic segment. Present neural network-based systems provide full phonetic context information to the neural network, making it easy for the network to memorize, rather than generalize, which leads to poor performance on any phone sequence other than one of those on which the system has been trained.

Thus, there is a need for a neural network system that avoids the effects when the neural network depends only on chance correlations in training data and instead provides efficient segment durations.

BRIEF DESCRIPTION OF THE DRAWINGS

FIG. 1 is a block diagram of a neural network that determines segment duration as is known in the art.

FIG. 2 is a block diagram of a rule-based system for determining segment duration as is known in the art.

DETAILED DESCRIPTION OF A PREFERRED EMBODIMENT

Figure 3:
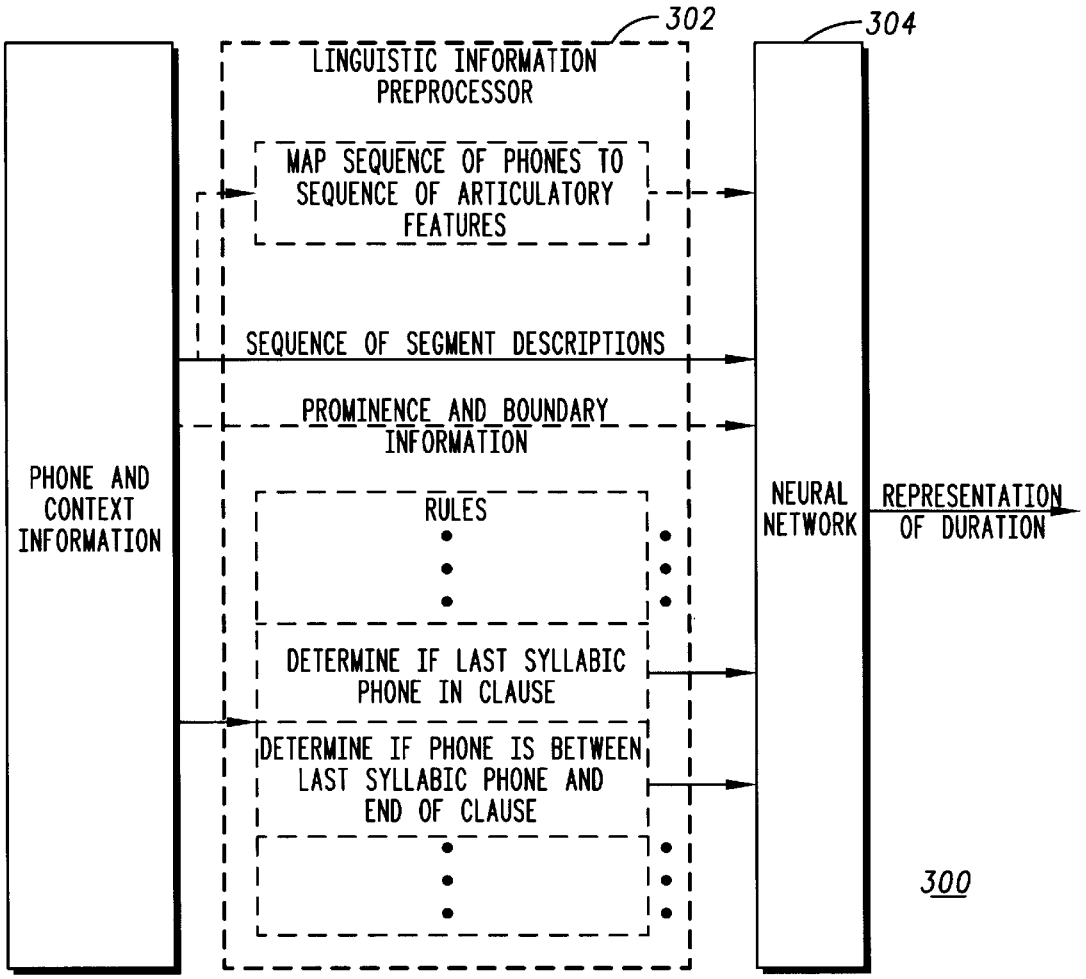
FIG. 3 is a block diagram of a device/system in accordance with the present invention.

The present invention teaches utilizing at least one of: mapping a sequence of phones to a sequence of articulatory features and utilizing prominence and boundary information, in addition to a predetermined set of rules for type, phonetic context, syntactic and prosodic context for segments to provide provide a system that generates segment durations efficiently with a small training set.

FIG. 1, numeral 100, is a block diagram of a neural network that determines segment duration as is known in the art. The input provided to the network is a sequence of representations of phonemes (102), one of which is the current phoneme, i.e., the phoneme for the current segment, or the segment for which the duration is being determined. The other phonemes are the phonemes associated with the adjacent segments, i.e., the segments that occur in sequence with the current segment. The output of the neural network (104) is the duration (106) of the current segment. The network is trained by obtaining a database of speech, and dividing it into a sequence of segments. These segments, their durations, and their contexts then provide a set of exemplars for training the neural network using some training algorithm such as back-propagation of errors.

FIG. 2, numeral 200, is a block diagram of a rule-based system for determining segment duration as is known in the art. In this example, phone and context data (202) is input into the rule-based system. Typically, the rule-based system utilizes certain preselected rules such as (1) determining if a segment is a last segment expressing a syllabic phone in a clause (204) and (2) determining if a segment is between a last segment expressing a syllabic phone and an end of a clause (206), multiplexes (208, 210) the outputs from the bipolar question to weight the outputs in accordance with a predetermined scheme and send the weighted outputs to multipliers (212, 214) that are coupled serially to receive output information. The phone and context data then is sent as phone information (216) and a stress flag that shows whether the phone is stressed (218) to a look-up table (220). The output of the look-up table is sent to another multiplier (222) serially coupled to receive outputs and to a summer (224) that is coupled to the multiplier (222). The summer (224) outputs the duration of the segment.

FIG. 3, numeral 300, is a block diagram of a device/system in accordance with the present invention. The device generates segment durations for input text in a text-to-speech system that generates a linguistic description of speech to be uttered including at least one segment description. The device includes a linguistic information preprocessor (302) and a pretrained neural network (304). The linguistic information preprocessor (302) is operably coupled to receive the linguistic description of speech to be uttered and is used for generating an information vector for each segment description in the linguistic description, wherein the information vector includes a description of a sequence of segments surrounding the described segment and descriptive information for a context associated with the segment. The pretrained neural network (304) is operably coupled to the linguistic information preprocessor (302) and is used for generating a representation of the duration associated with the segment by the neural network.

Typically, the linguistic description of speech includes a sequence of phone identifications, and each segment of speech is the portion of speech in which one of the identified phones is expressed. Each segment description in this case includes at least the phone identification for the phone being expressed.

Descriptive information typically includes at least one of: A) articulatory features associated with each phone in the sequence of phones; B) locations of syllable, word and other syntactic and intonational boundaries; C) syllable strength information; D) descriptive information of a word type; and E) rule firing information, i.e., information that causes a rule to operate.

The representation of the duration is generally a logarithm of the duration. Where desired, the representation of the duration may be adjusted to provide a duration that is greater than a duration that the pretrained neural network has been trained to provide. Typically, the pretrained neural network is a feedforward neural network that has been trained using back-propagation of errors.

Training data for the pretrained network is generated by recording natural speech, partitioning the speech data into identified phones, marking any other syntactical intonational and stress information used in the device and processing into informational vectors and target output for the neural network.

The device of the present invention may be implemented, for example, in a text-to-speech synthesizer or any text-to-speech system.

Figure 4:
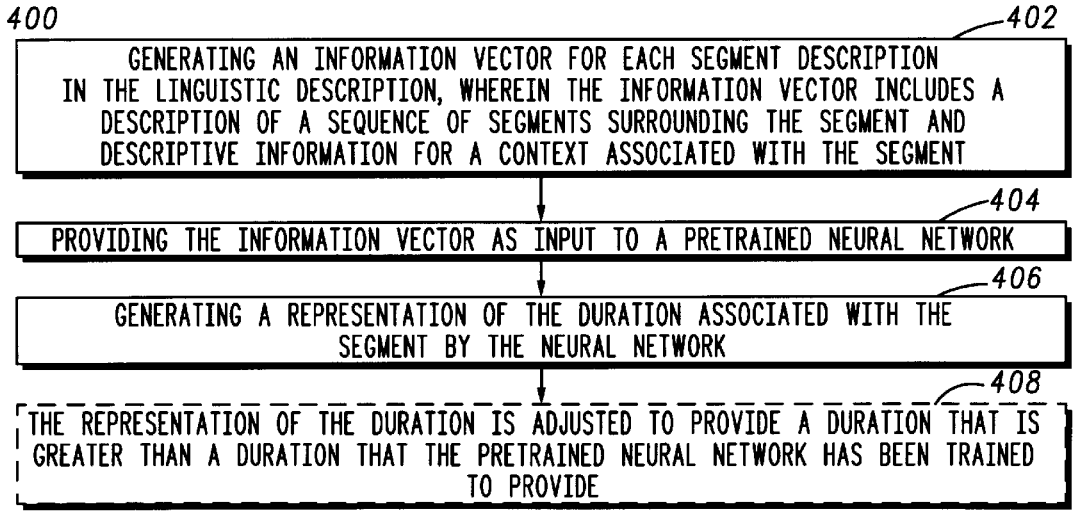
FIG. 4 is a flow chart of one embodiment of steps of a method in accordance with the present invention.

FIG. 4, numeral 400, is a flow chart of one embodiment of steps of a method in accordance with the present invention. The method provides for generating segment durations in a text-to-speech system, for input text that generates a linguistic description of speech to be uttered including at least one segment description. The method includes the steps of: A) generating (402) an information vector for each segment description in the linguistic description, wherein the information vector includes a description of a sequence of segments surrounding the described segment and descriptive information for a context associated with the segment; B) providing (404) the information vector as input to a pretrained neural network; and C) generating (406) a representation of the duration associated with the segment by the neural network.

As in the device, the linguistic description of speech includes a sequence of phone identifications and each segment of speech is the portion of speech in which one of the identified phones is expressed. Each segment description in this case includes at least the phone identification for the phone being expressed.

As in the device, descriptive information includes at least one of: A) articulatory features associated with each phone in the sequence of phones; B) locations of syllable, word and other syntactic and intonational boundaries; C) syllable strength information; D) descriptive information of a word type; and E) rule firing information.

Representation of the duration is generally a logarithm of the duration, and where selected, may be adjusted to provide a duration that is greater than a duration that the pretrained neural network has been trained to provide (408). The pretrained neural network is typically a feedforward neural network that has been trained using back-propagation of errors. Training data is typically generated as described above.

Figure 5:
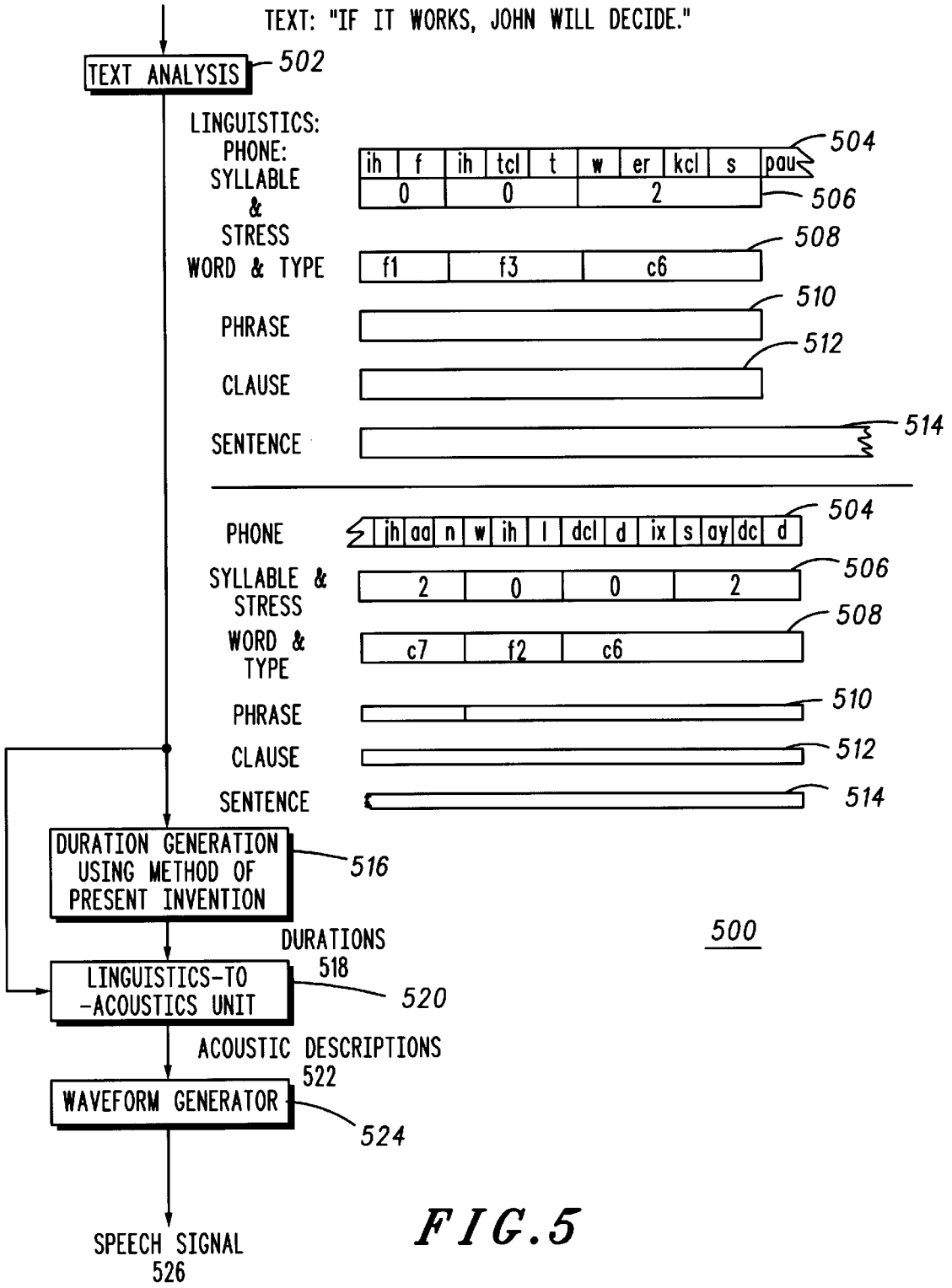
FIG. 5 illustrates a text-to-speech synthesizer incorporating the method of the present invention.

FIG. 5, numeral 500, illustrates a text-to-speech synthesizer incorporating the method of the present invention. Input text is analyzed (502) to produce a string of phones (504), which are grouped into syllables (506). Syllables, in turn, are grouped into words and types (508), which are grouped into phrases (510), which are grouped into clauses (512), which are grouped into sentences (514). Syllables have an indication associated with them indicating whether they are unstressed, have secondary stress in a word, or have the primary stress in the word that contains them. Words include information indicating whether they are function words (prepositions, pronouns, conjunctions, or articles) or content words (all other words). The method is then used to generate (516) durations (518) for segments associated with each of the phones in the sequence of phones. These durations, along with the result of the text analysis, are provided to a linguistics-to-acoustics unit (520), which generates a sequence of acoustic descriptions (522) of short speech frames (10 ms. frames in the preferred embodiment). This sequence of acoustic descriptions is provided to a waveform generator (524), which produces the speech signal (526).

Figure 6:
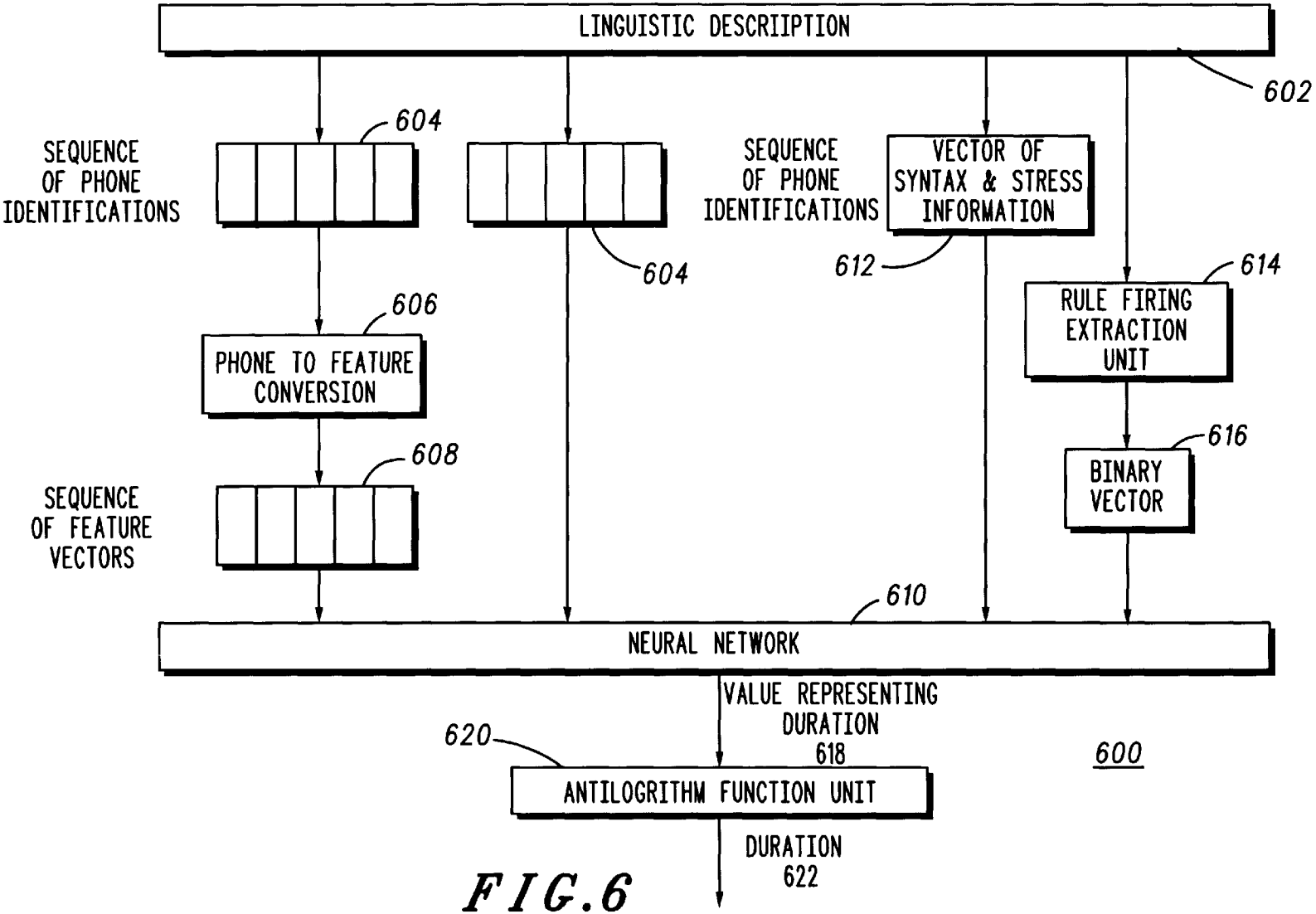
FIG. 6 illustrates the method of the present invention being applied to generate a duration for a single segment using a linguistic description.

FIG. 6, numeral 600, illustrates the method of the present invention being applied to generate a duration for a single segment using a linguistic description (602). A sequence of phone identifications (604) including the identification of the phone associated with the segment for which a duration is being generated are provided as input to the neural network (610). In the preferred embodiment, this is a sequence of five phone identifications, centered on the phone associated with the segment, and each phone identification is a vector of binary values, with one of the binary values in the vector set to one and the other binary values set to zero. A similar sequence of phones is input to a phone-to-feature conversion block (606), providing a sequence of feature vectors (608) as input to the neural network (610).

In the preferred embodiment, the sequence of phones provided to the phone-to-feature conversion block is identical to the sequence of phones provided to the neural network. The feature vectors are binary vectors, each determined by one of the input phone identifications, with each binary value in the binary vector representing some fact about the identified phone; for example, a binary value might be set to one if and only if the phone is a vowel. For one more similar sequence of phones, a vector of information (612) is provided describing boundaries which fall on each phone, and the characteristics of the syllables and words containing each phone. Finally, a rule firing extraction unit (614) processes the input to the method to produce a binary vector (616) describing the phone and the context for the segment for which duration is being generated. Each of the binary values in the binary vector is set to one if and only if some statement about the segment and its context is true; for example, "The segment is the last segment associated with a syllabic phone in the clause containing the segment." This binary vector (616) is also provided to the neural network. From all of this input, the neural network generates a value which represents the duration. In the preferred embodiment, the output of the neural network (value representing duration, 618) is provided to an antilogarithm function unit (620), which computes the actual duration (622) of the segment.

The steps of the method may be stored in a memory unit of a computer or alternatively, embodied in a tangible medium of/for a Digital Signal Processor, DSP, an Application Specific Integrated Circuit, ASIC, or a gate array.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A method for generating segment durations in a text-to-speech system, wherein, for input text that generates a linguistic description of speech to be uttered including at least one segment description, comprising the steps of:

A) generating a linguistic description-based information vector for each segment description in the linguistic description of the input text, wherein the information vector includes a description of a sequence of segments surrounding a described segment and descriptive information for a context associated with the described segment;

B) providing the information vector as input to a pretrained neural network having feedforward neural network elements, wherein the training data for the pretrained neural network has been generated by recording natural speech, partitioning the speech data into segments associated with identified phones, and marking at least one of syntactical, intonational, and stress information; and C) generating a representation of a duration associated with each phone in a sequence of phones in the described segment by the pretrained neural network.

2. The method of claim 1 wherein:

A) the speech is described as a sequence of phone identifications;

B) the segments for which duration is being generated are segments of speech expressing predetermined phones in the sequence of phone identifications; and C) segment descriptions include the phone identifications.

3. The method of claim 2 wherein the descriptive information includes at least one of:

A) articulatory features associated with each phone in the sequence of phones;

B) locations of syllable, word and other syntactic and intonational boundaries;

C) syllable strength information;

D) descriptive information of a word type; and

E) rule firing information.

4. The method of claim 1 wherein the representation of the duration is a logarithm of the duration.

5. The method of claim 1 wherein the pretrained neural network has been trained using back-propagation of errors.

6. The method of claim 1 wherein the steps of the method are stored in a memory unit of a computer.

7. The method of claim 1 wherein the steps of the method are embodied in a tangible medium of/for a Digital Signal Processor, DSP.

8. The method of claim 1 wherein the steps of the method are embodied in a tangible medium of/for an Application Specific Integrated Circuit, ASIC.

9. The method of claim 1 wherein the steps of the method are embodied in a tangible medium of a gate array.

10. A device for generating segment durations in a text-to-speech system, for input text that generates a linguistic description of speech to be uttered including at least one segment description, comprising:

A) a linguistic description-based information preprocessor, operably coupled to receive the linguistic description of speech to be uttered, for generating a linguistic description-based information vector for each segment description in the linguistic description of the speech to be uttered, wherein the information vector includes a description of a sequence of segments surrounding a described segment and descriptive information for a context associated with the described segment; and B) a pretrained neural network having feedforward neural network elements, wherein the training data for the pretrained neural network has been generated by recording natural speech, partitioning the speech data into segments associated with identified phones, and marking at least one of syntactical, intonational, and stress information, and wherein the pretrained neural network is operably coupled to the linguistic information preprocessor, for generating a representation of a duration associated with each phone in a sequence of phones in the described segment by the pretrained neural network.

11. The device of claim 10 wherein:

A) the speech is described as a sequence of phone identifications;

B) the segments for which the duration is being generated are segments of speech expressing predetermined phones in the sequence of phone identifications; and C) segment descriptions include the phone identifications.

12. The device of claim 11 wherein the descriptive information includes at least one of:

A) articulatory features associated with each phone in the sequence of phones;

B) locations of syllable, word and other syntactic and intonational boundaries;

C) syllable strength information;

D) descriptive information of a word type; and

E) rule firing information.

13. The device of claim 10 wherein the representation of the duration is a logarithm of the duration.

14. The device of claim 10 wherein the pretrained neural network has been trained using back-propagation of errors.

15. A text-to-speech synthesizer having a device for generating segment durations in a text-to-speech system, for input text that generates a linguistic description of speech to be uttered including at least one segment description, the device comprising:

A) a linguistic description-based information preprocessor, operably coupled to receive the linguistic description of speech to be uttered, for generating a linguistic description-based information vector for each segment description in the linguistic description of the input text, wherein the information vector includes a description of a sequence of segments surrounding a described segment and descriptive information for a context associated with the described segment; and B) a pretrained neural network having feedforward neural network elements, wherein the training data for the pretrained neural network has been generated by recording natural speech, partitioning the speech data into segments associated with identified phones, and marking at least one of syntactical, intonational, and stress information, and wherein the pretrained neural network is operably coupled to the linguistic information preprocessor, for generating a representation of a duration associated with each phone in a sequence of phones in the described segment by the pretrained neural network.

16. The text-to-speech synthesizer of claim 15 wherein:

A) the speech is described as a sequence of phone identifications;

B) the segments for which duration is being generated are segments of speech expressing predetermined phones in the sequence of phone identifications; and C) segment descriptions include the phone identifications.

17. The text-to-speech synthesizer of claim 16 wherein the information vector for each segment description includes at least one of:

A) articulatory features associated with each phone in the sequence of phones;

B) locations of syllable, word and other syntactic and intonational boundaries;

C) syllable strength information;

D) descriptive information of a word type; and

E) rule firing information.

18. The text-to-speech synthesizer of claim 15 wherein the representation of the duration is a logarithm of the duration.

19. The text-to-speech synthesizer of claim 15 wherein the pretrained neural network has been trained using back-propagation of errors.

20. The method of claim 1, further comprising the step of:

adjusting the representation of the duration associated with each phone in the sequence of phones in the described segment to provide another representation of the duration associated with each phone in the sequence of phones in the described segment.

21. The device of claim 13, wherein the representation of the duration associated with each phone in the sequence of phones in the described segment is adjusted to provide another representation of the duration associated with each phone in the sequence of phones in the described segment.

22. The text-to-speech synthesizer of claim 21, wherein the representation of the duration associated with each phone in the sequence of phones in the described segment is adjusted to provide another representation of the duration associated with each phone in the sequence of phones in the described segment.

* * * * *